US009683205B2

(12) United States Patent
Dabela et al.

(10) Patent No.: US 9,683,205 B2
(45) Date of Patent: Jun. 20, 2017

(54) PRINTING PRESS CLEANING COMPOSITIONS

(75) Inventors: Raymond Dabela, Chino Hills, CA (US); Jeffrey L. Rogers, Long Beach, CA (US)

(73) Assignee: Explorer Pressroom Solutions, Santa Fe Springs, CA (US)

( * ) Notice: Subject to any disclaimer, the term of this patent is extended or adjusted under 35 U.S.C. 154(b) by 822 days.

(21) Appl. No.: 13/218,299

(22) Filed: Aug. 25, 2011

(65) Prior Publication Data

US 2012/0220511 A1 Aug. 30, 2012

Related U.S. Application Data

(60) Provisional application No. 61/377,000, filed on Aug. 25, 2010.

(51) Int. Cl.

| | |
|---|---|
| ***C11D 1/12*** | (2006.01) |
| ***C11D 3/16*** | (2006.01) |
| ***C11D 3/18*** | (2006.01) |
| ***C11D 3/43*** | (2006.01) |

(52) U.S. Cl.

CPC . *C11D 3/43* (2013.01); *C11D 3/18* (2013.01)

(58) Field of Classification Search

CPC .... C11D 1/12; C11D 3/16; C11D 3/18; C11D 3/185; C11D 3/187; C11D 3/188

USPC ..... 510/171

See application file for complete search history.

(56) References Cited

U.S. PATENT DOCUMENTS

| | | | | |
|---|---|---|---|---|
| 5,691,288 | A * | 11/1997 | Dhillon | 510/171 |
| 6,929,702 | B1 * | 8/2005 | Motsenbocker | 134/6 |
| 2007/0135325 | A1 * | 6/2007 | Hawes et al. | 510/407 |
| 2008/0280801 | A1 | 11/2008 | Dabela et al. | |
| 2008/0280802 | A1 | 11/2008 | Dabela et al. | |

* cited by examiner

*Primary Examiner* — Ling Choi
*Assistant Examiner* — Thuy-Ai N Nguyen
(74) *Attorney, Agent, or Firm* — Lewis Roca Rothgerber Christie LLP

(57) ABSTRACT

Disclose herein are compositions of matter comprising at least one hydrocarbon solvent in between 1-50%, at least one surfactant in between 1-50%, and/or at least one aromatic solvent in between 1-75%. In addition, disclosed herein is a method of cleaning rollers, plates, or blankets of a printing machine with a cleaning mixture, the method comprising contacting the rollers or blankets with the cleaning mixture, wherein the cleaning mixture comprises a hydrocarbon solvent, an aromatic solvent, a methylated siloxane, and a surfactant.

11 Claims, No Drawings

PRINTING PRESS CLEANING COMPOSITIONS

RELATED APPLICATIONS

The present application claims priority to the U.S. Provisional Application Ser. No. 61/377,000, filed on Aug. 25, 2010, by Raymond Dabela et al., and entitled "PRINTING PRESS CLEANING COMPOSITIONS".

The present application is related to U.S. application Ser. No. 12/118,408, filed on May 9, 2008, by Raymond Dabela et al., and entitled "PRINTING PRESS CLEANING COMPOSITIONS", which is a continuation-in-part of the U.S. application Ser. No. 11/747,812, filed on May 11, 2007, by Raymond Dabela et al., and entitled "PRINTING PRESS CLEANING COMPOSITIONS", and also claims priority to the U.S. Provisional Application Ser. No. 60/969,579, filed on Aug. 31, 2007, by Raymond Dabela et al., and entitled "PRINTING PRESS CLEANING COMPOSITIONS". The entire disclosure of all of the above applications is incorporated by reference herein.

FIELD OF THE INVENTION

The present invention is in the field of cleaning solutions and mixtures, and particularly in the field of cleaning solutions and mixtures used in the printing industry.

BACKGROUND

Offset printing is a widely used printing technique where the inked image is transferred (or "offset") from a plate to a rubber blanket, then to the printing surface, e.g., paper. When used in combination with the lithographic process, which is based on the repulsion of oil and water, the offset technique employs a flat (planographic) image carrier on which the image to be printed obtains ink from ink rollers, while the non-printing area attracts a film of water, keeping the non-printing areas ink-free.

During the operation of the printing machine, ink regularly contaminates the non-printing areas, causing smears or smudges to appear on the printed surface, or in general interfere with the operation of the printing machine. In addition, pulp and dust from the paper used as the printing surface rises from the paper as the paper travels through the printing machine. This dust settles on the various parts of the printing machine, including the rollers, plates, and blankets, and contaminates these parts and interferes with the printing mechanism. In some applications, before they are fed to the printer, various pieces of paper are stacked on top of each other with a layer of spray powder, such as corn starch, separating them. The spray powder ensures that the pieces of paper do not stick together and are fed individually into the printing machine. Over time, the spray powder accumulates on the rollers, plates, and blankets and interferes with the printing mechanism.

Consequently, printing machines are cleaned regularly by applying a cleaning solution to the rollers, plates, and blankets to remove the ink and the grime from these parts. Traditionally, cleaning solutions have contained volatile organic compounds (VOCs). It is well-known that VOCs are not environmentally friendly. They are potential carcinogens, contribute to the depletion of the ozone layer, and may contribute to the green house effect that is responsible for global warming. As the result, governments have enacted restrictions on the use of VOCs in various industries, including the printing industry.

To comply with government regulations, various cleaning solutions having low VOC content have been marketed. These cleaning solutions are, for the most part, oil based. Oils have relatively low vapor pressures and are generally not considered to be volatile. However, oils are not satisfactory for use as printing machine cleaning agents. The oils in the cleaning solutions have a tendency to splatter. Once the oil has been used it accumulates at the bottom of the printing machine and then splatters on various parts, causing additional contamination. In addition, oils are difficult to remove and dispose.

Therefore, there is a need in the industry for a low VOC solvent that is compliant with governmental regulations, is economical to use, and cleans the printing machines efficiently and effectively.

SUMMARY OF THE INVENTION

Disclose herein are compositions of matter comprising at least one hydrocarbon solvent in between 1-50%, at least one surfactant in between 1-50%, and/or at least one aromatic solvent in between 1-75%. In addition, disclosed herein is a method of cleaning rollers, plates, or blankets of a printing machine with a cleaning mixture, the method comprising contacting the rollers or blankets with the cleaning mixture, wherein the cleaning mixture comprises a hydrocarbon solvent, an aromatic solvent, a methylated siloxane, and a surfactant.

DETAILED DESCRIPTION OF THE ILLUSTRATED EMBODIMENTS

In one aspect, disclosed herein is a composition comprising three or more of a hydrocarbon solvent, an aromatic solvent, a methylated siloxane, and a surfactant.

In some embodiments, the hydrocarbon solvent comprises a linear or branched alkyl chain, a cycloalkyl, a double bond, a triple bond, or a combination thereof. In other embodiments, the hydrocarbon solvent is a natural product. In certain embodiments, the hydrocarbon solvent comprises a $C_5$-$C_{30}$ hydrocarbon. As used herein, "$C_m$ to $C_n$" in which "m" and "n" are integers refers to the number of carbon atoms in an alkyl, alkenyl, alkynyl and the rings of cycloalkyl and cycloalkenyl group. That is, the alkyl, alkenyl or alkynyl can contain from "m" to "n", inclusive, carbon atoms.

In some embodiments, the hydrocarbon solvent is a mixture of at least two $C_5$-$C_{30}$ hydrocarbons. Thus, as used herein, the term "hydrocarbon solvent" refers not only to a solvent containing a single chemical species, but also to a solvent containing a mixture of two or more chemical species, each chemical species being a hydrocarbon.

In some embodiments, the hydrocarbon solvent is selected from the group consisting of limonene, lacolene, Pale Oil 100 (a naphthenic base oil), hexanes, naphtha, mineral spirits (also referred to as white spirits or Stoddard solvent), kerosene, Solvent 360, and Solvent 142. Solvent 142 is a low odor petroleum distillate blend that is used as an industrial cleaning solvent, and is suitable for use where low flash point mixtures cannot be tolerated.

In some embodiments, the hydrocarbon solvent comprises a heteroatom (i.e., at least one heteroatom) within the chain. In these embodiments, the hydrocarbon solvent is selected from the group consisting of an ether, a thioether, a secondary amine, and a tertiary amine. Examples of hydrocarbon solvent having a heteroatom include, but are not limited to, monoethylamine (MEA), diethylamine (DEA), and triethylamine (TEA).

In some preferred embodiments, the hydrocarbon solvent is an ether. In some of these embodiments, the hydrocarbon solvent comprises a carbon chain backbone, which is substituted with one or more alkoxy substituents. In other embodiments, the carbon chain backbone is also substituted with one or more hydroxyl substituent. In these embodiments, the hydrocarbon solvent is an alcohol. In other embodiments, the carbon chain backbone is substituted with both one or more alkoxy substituents and one or more hydroxyl substituents.

Examples of ethers include, but are not limited to, the family of glycol ethers. Glycol ethers are a group of solvents based on alkyl ethers of ethylene glycol. These solvents typically have higher boiling point, together with the favorable solvent properties of lower molecular weight ethers and alcohols. The original glycol ether is ethyl cellosolve. Glycol ethers can be also derived of diethylene glycol (carbitols).

Glycol ether solvents include, but are not limited to, ethylene glycol monomethyl ether (2-methoxyethanol, $CH_3OCH_2CH_2OH$), ethylene glycol monoethyl ether (2-ethoxyethanol, $CH_3CH_2OCH_2CH_2OH$), ethylene glycol monopropyl ether (2-propoxyethanol, $CH_3CH_2CH_2OCH_2CH_2OH$), ethylene glycol monoisopropyl ether (2-isopropoxyethanol, $(CH_3)_2CHOCH_2CH_2OH$), ethylene glycol monobutyl ether (2-butoxyethanol, $CH_3CH_2CH_2CH_2OCH_2CH_2OH$) (also referred to as glycol ether EB), ethylene glycol monophenyl ether (2-phenoxyethanol, $C_6H_5OCH_2CH_2OH$), ethylene glycol monobenzyl ether (2-benzyloxyethanol, $C_6H_5CH_2OCH_2CH_2OH$), diethylene glycol monomethyl ether (2-(2-methoxyethoxy)ethanol, methyl carbitol, $CH_3OCH_2CH_2OCH_2CH_2OH$), diethylene glycol monoethyl ether (2-(2-ethoxyethoxy)ethanol, carbitol cellosolve, $CH_3CH_2OCH_2CH_2OCH_2CH_2OH$), diethylene glycol mono-n-butyl ether (2-(2-butoxyethoxy) ethanol, $CH_3CH_2CH_2CH_2OCH_2CH_2OCH_2CH_2OH$), ethylene glycol dimethyl ether (dimethoxyethane, $CH_3OCH_2CH_2OCH_3$), ethylene glycol diethyl ether (diethoxyethane, $CH_3CH_2OCH_2CH_2OCH_2CH_3$), ethylene glycol dibutyl ether (dibutoxyethane, $CH_3CH_2CH_2CH_2OCH_2CH_2OCH_2CH_2CH_2CH_3$), ethylene glycol methyl ether acetate (2-methoxyethyl acetate, $CH_3OCH_2CH_2OCOCH_3$), ethylene glycol monethyl ether acetate (2-ethoxyethyl acetate, $CH_3CH_2OCH_2CH_2OCOCH_3$), ethylene glycol monobutyl ether acetate (2-butoxyethyl acetate, $CH_3CH_2CH_2CH_2OCH_2CH_2OCOCH_3$). In some embodiments, the aromatic solvent comprises an optionally substituted phenyl ring. Unless otherwise indicated, when a compound, or a portion thereof, is deemed to be "optionally substituted," it is meant that the substituted compound, or portion thereof, is a group that may be substituted with one or more group(s) individually and independently selected from alkyl, alkenyl, alkynyl, cycloalkyl, aryl, heteroaryl, heteroalicyclic, hydroxyl, alkoxy, aryloxy, mercapto, alkylthio, arylthio, cyano, halo, carbonyl, thiocarbonyl, O-carbamyl, N-carbamyl, O-thiocarbamyl, N-thiocarbamyl, C-amido, N-amido, S-sulfonamido, N-sulfonamido, C-carboxy, O-carboxy, isocyanato, thiocyanato, isothiocyanato, nitro, silyl, trihalomethanesulfonyl, and amino, including mono- and di-substituted amino groups, and the protected derivatives thereof. The protecting groups that may form the protective derivatives of the above substituents are known to those of skill in the art and may be found in references such as Greene and Wuts, Protective Groups in Organic Synthesis, 3rd Ed., John Wiley & Sons, New York, N.Y., 1999, which is incorporated herein in its entirety.

In some embodiments, the aromatic solvent is a mixture of at least two compounds, each of which comprises an optionally substituted phenyl ring. Thus, as used herein, the term "aromatic solvent" refers not only to a solvent containing a single chemical species, but also to a solvent containing a mixture of two or more chemical species, each chemical species being an aromatic compound. Examples of aromatic solvent include, but are not limited to, toluene, xylene, 1,2,4-trimethylbenzene, 1,3,5-trimethylbenzene, cumene, Aromatic 100, (petroleum hydrocarbon mixture of $C_{9-11}$ aromatic hydrocarbons which contain 1,2,4-trimethylbenzene, xylene, cumene and ethyl benzene), Aromatic 150 (petroleum hydrocarbon mixture of $C_{9-11}$ aromatic hydrocarbons which contain napthalene), benzene, and ethyl benzene.

In some embodiments, the aromatic solvent comprises an optionally substituted halobenzene. A "halobenzene" is a benzene or phenyl group that is substituted with one or more halogens, such as fluoro, chloro, bromo, or iodo. In certain embodiments, the aromatic solvent comprises an optionally substituted perhaloalkylbenzene. A "perhaloalkylbenzene" is a benzene or phenyl group that is substituted with one or more alkyl groups, all of whose hydrogen atoms have been replaced by a halogen. Examples of perhaloalkyl groups include, but are not limited to, trifluoromethyl, trichloromethly, tribromomethyl, pentafluoroethyl, pentachloroethly, and the like. In some embodiments, the aromatic solvent is 1-chloro-4-(trifluoromethyl)benzene, also known as parachlorobenzotriflouride (PCBTF) or "Oxol 100®". In some embodiments, the halobenzene is present in the range of between 15-45% by volume. In other embodiments, the halobenzene is present in the range of between 20-40% by volume. In yet other embodiments, the halobenzene is present in the range of between 20-30% by volume.

In some embodiments, the methylated siloxane is a cyclic, branched, or linear methylated siloxane. A siloxane comprises several terminal —OH groups. In a "methylated siloxane" the hydrogen atom of at least one of the —OH groups is replaced with a methyl group. In some embodiments, the methylated siloxane comprises between 4-20 methyl groups.

In some embodiments, the methylated siloxane is a mixture of at least two methylated siloxanes. Thus, as used herein, the term "methylated siloxane" refers not only to a solvent containing a single chemical species, but also to a solvent containing a mixture of two or more chemical species, each chemical species being a methylated siloxane.

In some embodiments, the methylated siloxane is selected from the group consisting of octamethylcyclotetrasiloxane, also known as cyclomethicone or D4, decamethylcyclopentasiloxane (SF 1202 or D5), dodecamethylcyclohexasiloxane (also known as D6), Dow Corning 244, Dow Corning 345, Dow Corning OS-10, Dow Corning OS-20, Dow Corning OS-30, SF 1173, silicone polyalkyleneoxide polymers, such as CoatOSil* 1220 and CoatOSil* 1221 (Momentive, Columbus, Ohio), and a combination thereof.

Cyclic, branched, or linear, completely methylated siloxanes (VMS) are listed within group II as exempt compounds under South Coast Air Quality Management District (SCAQMD) Rule 102. SCAQMD Rule 1171 prohibits the use of group II compounds but specifically allows the use of VMS. In some preferred embodiments, the methylated siloxanes used in the compositions disclosed herein are only the cyclic volatile completely methylated siloxanes.

Dow Corning 244 fluid consists of greater than 60 percent octamethylcyclotetrasiloxane (D4). Dow Corning 345 fluid is a mixture of 30 to 40 percent dodecamethylcyclohexasiloxane (D6) with the balance being decamethylcyclopentasiloxane. Dow Corning OS-10 consists of greater than 60 percent hexamethyldisiloxane (HMDS), which is a linear, volatile, completely methylated siloxane. Dow Corning OS-20 consists of 85.0-100% octamethyltrisiloxane. Dow Corning OS-30 consists of greater than 60 percent decamethyltetrasiloxane.

In some embodiments, the siloxane is present in the range of between 1-55% by volume. In other embodiments, the siloxane is present in the range of between 25-50% by volume. In yet other embodiments, the siloxane is present in the range of between 25-35% by volume.

In some embodiments, the surfactant can also act as an emulsifier. Typically, surfactants are long chain hydrocarbons, which may comprise one or more points of unsaturation, i.e., double (both cis and trans) or triple bonds. In some embodiments, the surfactant comprises a fatty acid or a salt or ester thereof.

Fatty acids are long chain hydrocarbons, typically containing a carboxyl group at one terminus, which are normally obtained from hydrolyzing fats or oils. Some synthetic long chain hydrocarbons can also be called fatty acids, even though they are not obtained from naturally occurring fats or oils. In the context of the present disclosure, the term "fatty acid" includes any long chain hydrocarbon, even if the chain does not contain a carboxyl group. By "long chain" it is meant that the hydrocarbon chain comprises 5-50 carbon atoms (e.g., a $C_5$-$C_{50}$ chain). In some embodiments, the fatty acid is selected from the group consisting of caproic acid, caprylic acid, capric acid, lauric acid, myristic acid, palmitic acid, stearic acid, arachidic acid, behenic acid, myristoleic acid, palmitoleic acid, oleic acid, linoleic acid, alpha-linolenic acid, arachidonic acid, eicosapentaenoic acid, erucic acid, and docosahexaenoic acid. In some embodiments, the fatty acid is oleic acid.

In some embodiments, the fatty acid is esterified. In certain embodiments, the esterified fatty acid is a methylated fatty acid, which include, but are not limited to, the methylated form of the above-mentioned fatty acids. In some embodiments, the methylated fatty acid is used in combination with the methylated siloxane, whereas in other embodiments, the methylated fatty acid is used in lieu of the methylated siloxane.

In some embodiments, the composition comprises a mixture of methylated fatty acids, for example, a mixture of methyl palmitate, methyl stearate, methyl oleate, and/or methyl linoleate. Certain commercially available products comprise a mixture of the above methylated fatty acids, for example CE-1618, CE-1618 Kosher, and CE-1618LG (The Proctor & Gamble Company, Cincinnati, Ohio).

In some embodiments, the surfactant is a salt or ester of oleic acid, which can optionally be selected from, for example, sorbitan monooleate or methyl oleate.

In other embodiments, the surfactant is a salt or ester of linolenic acid, for example, the methyl ester of linolenic acid.

In some embodiments, the surfactant is a mixture of fatty acid esters. Examples of such mixtures include NORFOX® MSY (methyl soyate) (Norman, Fox & Co., Vernon, Calif.), which is predominantly (51.5%) the methyl ester of linolenic acid.

In some embodiments, the surfactant is a salt of an alkyl aromatic sulfonic acid. This particular surfactant can be an amine, alkali metal, or ammonium salt of an alkyl aromatic sulfonic acid as an anionic emulsifier. The alkylaromatic hydrophobe solubilizes well in oily mixtures. This surfactant emulsifier produces little foam, compared to conventional anionic surfactants. The surfactant may be an amine, alkali metal, or ammonium salt of an alkyl benzene or alkyl naphthalene sulfonic acid. Examples include, but are not limited to, an isopropylamine salt of linear dodecylbenzene sulfonic acid, an isopropylamine salt of branched dodecylbenzene sulfonic acid, a diethanolamine salt of linear or branched dodecylbenzene sulfonic acid, and the like, as well as mixtures thereof. In some embodiments, the alkyl aromatic sulfonic acid is selected from the group consisting of isopropylamine linear dodecylbenzene sulfonate (CALIMULSE PRS), monoethylamine linear dodecylbenzene sulfonate, diethylamine linear dodecylbenzene sulfonate, and triethylamine linear dodecylbenzene sulfonate. In other embodiments, the alkyl aromatic sulfonic acid is the sodium salt of dodecylbenzene sulfonate (NORFOX® 40).

In some embodiments, the surfactant is a polyoxide compound. In some embodiments, the polyoxide compound comprises ethylene oxide (—$CH_2CH_2O$—). In some embodiments, the polyoxide compound comprises n-propylene oxide or i-propylene oxide (—$CH_2CH_2CH_2O$— or —$CH_2CH(CH_3)O$—). In some embodiments, the polyoxide compound comprises both ethylene oxide and propylene oxide monomeric units. In some embodiments, the polyoxide compound is an alkyl EO/PO copolymer, for example, TERGITOL™ XH surfactant (Dow Chemical Co.).

In some embodiments, the surfactant is a mixture of at least two surfactants. Thus, as used herein, the term "surfactant" refers not only to a solvent containing a single chemical species, but also to a solvent containing a mixture of two or more chemical species, each chemical species acting as a surfactant.

In some embodiments, the composition described herein comprises less than 50% by volume of a hydrocarbon solvent. In some embodiments, the composition comprises 1-50% by volume of hydrocarbon solvent. In other embodiments, the amount of the hydrocarbon solvent is 2% or more, for example 3% or more, 4% or more, 5% or more, 10% or more, 15% or more, or 20% or more. In some embodiments, the amount of hydrocarbon solvent is less than 45%, for example less than 40%, or less than 35%, or less than 30%. In some embodiments, the composition comprises no hydrocarbon solvent.

In some embodiments, the composition described herein comprises less than 75% by volume of an aromatic solvent. In some embodiments, the composition comprises 1-50% by volume of aromatic solvent. In other embodiments, the amount of the aromatic solvent is 2% or more, for example 3% or more, 4% or more, 5% or more, 10% or more, 15% or more, or 20% or more. In some embodiments, the amount of aromatic solvent is less than 45%, for example less than 40%, or less than 35%, or less than 30%. In some embodiments, the composition comprises no aromatic solvent.

In some embodiments, the composition described herein comprises less than 75% by volume of a methylated siloxane. In some embodiments, the composition comprises 1-50% by volume of methylated siloxane. In other embodiments, the amount of the methylated siloxane is 2% or more, for example 3% or more, 4% or more, 5% or more, 10% or more, 15% or more, 20% or more, 25% or more, or 30% or more. In some embodiments, the amount of methylated siloxane is less than 45%, for example less than 40%, or less than 35%, or less than 30%. In some embodiments, the composition comprises no methylated siloxane.

In some embodiments, the composition described herein comprises and less than 75% by volume of a surfactant. In some embodiments, the composition comprises 1-50% by volume of surfactant. In other embodiments, the amount of the surfactant is 2% or more, for example 3% or more, 4% or more, 5% or more, 10% or more, or 15% or more. In some embodiments, the amount of surfactant is less than 45%, for example less than 40%, or less than 35%, or less than 30%. In some embodiments, the composition comprises no surfactant.

In some embodiments, the compositions described herein further comprise water. In some embodiments, the water is deionized water. In other embodiments, the water is distilled water. In further embodiments, the water is purified through reverse osmosis process.

The compositions disclosed herein have the advantage that they comprise low VOC components, i.e., the VOC content of the compositions is less than 200 g/L, and in some embodiments less than 150 g/L, in other embodiments 100 g/L, and in certain embodiments, less than 100 g/L.

In some embodiments, the compositions disclosed herein comprise less than 200 g/L of VOCs before water is added. After distilled water is added, the VOC content of the compositions is less than 100 g/L.

In some embodiments, the compositions disclosed herein comprise at least one basic component. The inclusion of the basic component is useful in cleaning the metal components of the printing press. In some embodiments, the basic component is soda ash, i.e., sodium carbonate. In other embodiments, the basic component is sodium tripolyphosphate. In certain embodiments, the basic component comprises sodium metasilicate. In other embodiments, the basic component comprises more than one basic component.

In another aspect, disclosed herein is a composition comprising an aromatic solvent, a methylated siloxane, and a surfactant, as these terms are described herein.

In another aspect, disclosed herein is a composition comprising a hydrocarbon solvent, a methylated siloxane, and a surfactant, as these terms are described herein.

In another aspect, disclosed herein is a composition comprising a hydrocarbon solvent, an aromatic solvent, and a surfactant, as these terms are described herein.

In another aspect, disclosed herein is a composition comprising a hydrocarbon solvent, an aromatic solvent, and a methylated siloxane, as these terms are described herein.

In some embodiments, the composition described herein is in the form of a solution, whereas in other embodiments, the composition is an emulsion.

Thus, in another aspect, described herein is a method of preparing an emulsion for cleaning purposes comprising mixing a solution at a rate of greater than 500 rpm for at least two hours, wherein the solution comprises a hydrocarbon solvent, an aromatic solvent, a methylated siloxane, and a surfactant, as these terms are described above. In some embodiments, the solution is mixed for about 4 hours. In other embodiments, the solution is mixed for about 8 hours. In yet other embodiments, the solution is mixed for about 12 hours. In further embodiments, the solution is mixed for about 24 hours. In other embodiments, the solution is mixed for longer than 24 hours.

In some embodiments, the solution is mixed at a rate of about 600 rpm. In other embodiments, the solution is mixed at a rate of less than 4000 rpm. In certain embodiments, the solution is mixed at a rate of between 600-3600 rpm.

The compositions described herein are best used for cleaning certain parts of printing machines, such as rollers, plates, or blankets. Thus, in another aspect, disclosed herein is a method of cleaning rollers, plates, or blankets of a printing machine with a cleaning mixture, the method comprising contacting the rollers or blankets with the cleaning mixture, wherein the cleaning mixture comprises a hydrocarbon solvent, an aromatic solvent, a methylated siloxane, and a surfactant, as these terms are described above. In some embodiments, the cleaning mixture is a solution, whereas in other embodiments, the cleaning mixture is an emulsion.

The compositions disclosed herein provide a low VOC (volatile organic compounds) wash mixtures that are effective in a wide range of applications. These compositions can be used on, for example, sheet fed, automatic, web, or heat set printing machines. In some embodiments, the compositions are used in an automated cleaning system, while in other embodiments, the compositions are used manually to clean the printing presses.

When the operator of the printing machine decides that the parts of the printing machine, such as rollers, plates, or blankets, need to be cleaned, the operator can stop the ink and water flow to the rollers, and then pour the cleaning mixture, whether the solution or the emulsion, over the rollers. The cleaning solution moves through the printing machine and flows downwards, as ink or water would, and cleans the surface areas with which it comes in contact. In some embodiments, it is not necessary to stop the flow of paper through the printing machine during the cleaning cycle because the cleaning cycle takes a short amount of time. In other embodiments, the operator first stops the flow of paper through the printing machine and then, while the rollers and plates are still rotating, applies the cleaning mixture.

In another aspect, disclosed herein is a composition comprising at least one hydrocarbon solvent in between 1-50%, at least one surfactant in between 1-50%, and at least one aromatic solvent in between 1-50%, with the remainder being water. The percentages are listed in terms of volume percents (e.g., 1% denotes 1 mL of the ingredient per 100 mL of the composition). In some embodiments, the hydrocarbon solvent is a mixture of two or more hydrocarbon or oils, each of which is present in between 1-50%. In certain embodiments, the surfactant is a mixture of two or more surfactants, each of which is present in between 1-50%. It is understood by those of ordinary skill in the art that some hydrocarbon solvents and some oils act as surfactants.

In some embodiments, the hydrocarbon solvent is a mixture of two or more of the following: d-limonene, Solvent 142, and Pale Oil 100. Solvent 142 is a mixture of paraffins. Thus in some embodiments, the hydrocarbon solvent comprises paraffins. Pale Oil 100 (Houston Refining, Houston, Tex.) is a mixture naphthenic petroleum distillates (CAS Nos. 64742-52, 64742-53, 64741-96), comprising both heavy and light naphthenic distillates.

In some embodiments, the aromatic solvent is Oxol 100, as defined herein.

In some embodiments, the surfactant is a mixture of two or more of Calimulse PRS, SMO, CE-1270, CE-1618, and Pale Oil 100, as defined herein.

"SMO" stands for sorbitan monooleate. CE-1270 (CAS No. 67762-40-7) (P&G Chemicals Americas, Cincinnati, Ohio) is a mixture of methyl laureate (70.5-74.5%) and methyl myristate (24-29%).

In some embodiments, the composition comprises: d-limonene in between 1-10%; Solvent 142 in between 1-8%; Calimulse PRS in between 1-5%; Oxol 100 in between 1-50%; SMO in between 1-5%; Pale Oil 100 or CE-1270 in between 1-50%; and the remainder being water.

In some embodiments, the composition comprises:—limonene in between 1-30%; Oxol 100 in between 1-75%; alkyl EO/PO copolymer in between 1-50%; methyl soyate in between 1-50%, and the remainder being water.

It is understood that all of the percentages given above include a 25% deviation from the stated figure. For example, "in between 1-5%" means "in between 1±0.25-5±1.25%", or a particular ingredient being present at 4% means the ingredient is present at 4±1%.

In another aspect, disclosed herein are methods of cleaning rollers, plates, or blankets of a printing machine with a cleaning mixture, the method comprising contacting the rollers or blankets with the cleaning mixture, wherein the cleaning mixture is as described above.

In some embodiments, other cleaning mixtures whose specific ingredients and percentages are disclosed in the Examples section of U.S. Application Publications 2008/0280801 and 2008/0280802 can be used. The Examples sections and the disclosure of the particular mixtures in these applications are incorporated by reference herein.

EXAMPLES

The following examples are non-limiting and are presented only to illustrate some of the embodiments disclosed herein.

Example 1

Blanket and Roller Wash Mixtures

The following mixtures provide a low VOC (volatile organic compounds) roller and blanket wash mixture that is effective in a wide range of applications. The following mixtures can be used on, for example, sheet fed, automatic, web, or heat set printing machines. In the following, all volume fractions were determined at room temperature.

Mixture 1

| Ingredients | Volume Fraction |
|---|---|
| Xylene | 0.2 |
| Hi Sol 10 | 0.3 |
| Kerosene | 0.07 |
| EXPL-SP | 0.045 |
| Pale Oil 100 | 0.1 |
| Vanilla Fragance | 0.0004 |
| Water | 0.28 |
| SMO | 0.009 |
| Net | 1 |

"Hi Sol 10" (Rodda Paint Co., Portland, Oreg.) is an aromatic solvent distributed by comprising 60-70% solvent naphtha (CAS No. 64742-95-6), 20-30% 1,2,4-trimethylbenzene (CAS No. 95-63-6), 0-10% 1,3,5-trimethylbenzene (CAS No. 108-67-8), 0-10% xylene (CAS No. 1330-20-7), and 0-10% ethylbenzene (CAS No. 100-41-4).

"EXPL-SP" is a combination of various surfactants, including SMO, Pale Oil 100, Calimulse PRS, and nonylphenol ethoxylate, each present in a range of between 10-50%.

Mixture 2

| Ingredients | Fraction |
|---|---|
| d-Limonene | 8% |
| Solvent 142 | 4% |
| Calimulse PRS | 1.4% |
| Oxol 100 | 38% |
| SMO | 2.5% |
| Pale Oil 100 | 20% |
| Water | 26.1% |
| Net | 100% |

Mixture 3

| Ingredients | Fraction |
|---|---|
| d-Limonene | 8% |
| Solvent 142 | 4% |
| Calimulse PRS | 1.4% |
| Oxol 100 | 38% |
| SMO | 2.5% |
| CE-1270 | 20% |
| Water | 26.1% |
| Net | 100% |

What is claimed is:

1. A composition consisting essentially of
d-limonene in between 5-10% by volume;
paraffins in between 2-8% by volume;
isopropylamine linear dodecylbenzene sulfonate in between 1-5% by volume;
1-chloro-4-(trifluoromethyl)benzene in between 20-50% by volume;
sorbitan monooleate in between 1-5% by volume;
naphthenic petroleum distillates or methyl laureate/methyl myristate in between 10-50% by volume; and
the remainder being water.

2. The composition of claim 1, wherein the composition consists essentially of:
d-limonene at 8%,
paraffins at 4% by volume,
isopropylamine linear dodecylbenzene sulfonate at 1.4% by volume,
1-chloro-4-(trofluoromethyl)benzene at 38% by volume,
sorbitan monooleate at 2.5% by volume, and
naphthenic petroleum distillates at 20% by volume,
and the remainder being water.

3. The composition of claim 1, wherein the composition consists essentially of:
d-limonene at 8% by volume,
paraffins at 4% by volume,
isopropylamine linear dodecylbenzene sulfonate at 1.4% by volume,
1-chloro-4-(trofluoromethyl)benzene at 38% by volume,
sorbitan monooleate at 2.5% by volume, and
methyl laurate/methyl myristate at 20% by volume,
and the remainder being water.

4. A composition comprising:
a mixture of solvent naphtha, 1,2,4-trimethylbenzene, 1,3,5-trimethylbenzene, xylene, and ethylbenzene, the mixture present at 30% by volume;
additional xylene at 20% by volume;

kerosene at 7% by volume;

a mixture of sorbitan monooleate, heavy and light naphthenic distillates, isopropylamine linear dodecylbenzene sulfonate, and nonylphenol ethoxylate, the mixture present at 4.5% by volume;

additional heavy and light naphthenic distillates at 10% by volume; and additional sorbitan monooleate at 0.9% by volume.

5. The composition of claim 1, consisting of d-limonene in between 5-10% by volume;

paraffins in between 2-8% by volume;

isopropylamine linear dodecylbenzene sulfonate in between 1-5% by volume;

1-chloro-4-(trifluoromethyl)benzene in between 20-50% by volume;

sorbitan monooleate in between 1-5% by volume;

naphthenic petroleum distillates or methyl laureate/methyl myristate in between 10-50% by volume; and the remainder being water.

6. The composition of claim 1, consisting of:

d-limonene at 8%, paraffins at 4% by volume, isopropylamine linear dodecylbenzene sulfonate at 1.4% by volume, 1-chloro-4-(trofluoromethyl)benzene at 38% by volume, sorbitan monooleate at 2.5% by volume, and naphthenic petroleum distillates at 20% by volume, and the remainder being water.

7. The composition of claim 1, consisting of:

d-limonene at 8% by volume, paraffins at 4% by volume, isopropylamine linear dodecylbenzene sulfonate at 1.4% by volume, 1-chloro-4-(trofluoromethyl)benzene at 38% by volume, sorbitan monooleate at 2.5% by volume, and methyl laurate/methyl myristate at 20% by volume, and the remainder being water.

8. The composition of claim 1, consisting essentially of:

d-limonene at 8%, paraffins at 3% by volume, isopropylamine linear dodecylbenzene sulfonate at 1.4% by volume, 1-chloro-4-(trofluoromethyl)benzene at 38% by volume, sorbitan monooleate at 2.5% by volume, and naphthenic petroleum distillates at 20% by volume, and the remainder being water.

9. The composition of claim 1, consisting essentially of:

d-limonene at 8% by volume, paraffins at 3% by volume, isopropylamine linear dodecylbenzene sulfonate at 1.4% by volume, 1-chloro-4-(trofluoromethyl)benzene at 38% by volume, sorbitan monooleate at 2.5% by volume, and methyl laurate/methyl myristate at 20% by volume, and the remainder being water.

10. The composition of claim 1, consisting of:

d-limonene at 8%, paraffins at 3% by volume, isopropylamine linear dodecylbenzene sulfonate at 1.4% by volume, 1-chloro-4-(trofluoromethyl)benzene at 38% by volume, sorbitan monooleate at 2.5% by volume, and naphthenic petroleum distillates at 20% by volume, and the remainder being water.

11. The composition of claim 1, consisting of:

d-limonene at 8% by volume, paraffins at 3% by volume, isopropylamine linear dodecylbenzene sulfonate at 1.4% by volume, 1-chloro-4-(trofluoromethyl)benzene at 38% by volume, sorbitan monooleate at 2.5% by volume, and methyl laurate/methyl myristate at 20% by volume, and the remainder being water.

* * * * *